United States Patent [19]

Freed

[11] Patent Number: 5,027,262

[45] Date of Patent: Jun. 25, 1991

[54] FLEXIBLE LIGHT RAIL

[75] Inventor: Herbert D. Freed, Miami Beach, Fla.

[73] Assignee: Lucifier Lighting Company, San Antonio, Tex.

[21] Appl. No.: 341,736

[22] Filed: Apr. 20, 1989

Related U.S. Application Data

[63] Continuation-in-part of Ser. No. 198,083, May 24, 1988, Pat. No. 4,874,320.

[51] Int. Cl.[5] ..... F21V 21/00

[52] U.S. Cl. ..... 362/249; 362/247; 439/115

[58] Field of Search ..... 362/249, 237, 238, 241, 362/247, 296; 439/115, 239

[56] References Cited

U.S. PATENT DOCUMENTS

| | | | |
|---|---|---|---|
| 4,158,221 | 6/1979 | Agabekov | 362/249 X |
| 4,204,273 | 5/1980 | Goldberg | 362/238 X |
| 4,521,838 | 6/1985 | Agabekov | 362/249 |
| 4,569,568 | 2/1986 | Agabekov | 439/638 |
| 4,723,199 | 2/1988 | Freed et al. | 439/239 X |
| 4,874,320 | 10/1989 | Freed et al. | 439/239 X |

FOREIGN PATENT DOCUMENTS

| | | | |
|---|---|---|---|
| 564685 | 11/1932 | Fed. Rep. of Germany | 439/239 |
| 2451542 | 11/1980 | France | 362/249 |

*Primary Examiner*—Stephen F. Husar
*Attorney, Agent, or Firm*—Gunn, Lee & Miller

[57] ABSTRACT

A light rail system for supporting light fixtures which is flexible so as to conform to curved and irregular surfaces. The light rail has two strips, fabricated from a single piece of conductive material, surrounded by upper and lower tracks of insulative material. A concave reflecting surface is integral with the upper layer of insulative material. Extensions from the strips form contact tabs which are folded perpendicular to the strips, and extend through slits in the upper track. Source plugs integral with the conductive strips mate with a feed plug providing external electricity. A special coupler allows several rails to be joined together.

4 Claims, 3 Drawing Sheets

FLEXIBLE LIGHT RAIL

This is a continuation-in-part of co-pending application Ser. No. 198,083 filed May 24, 1988, now U.S. Pat. No. 4,874,320.

BACKGROUND OF THE INVENTION

1. Field of the Invention

The present invention generally relates to lighting systems, and more particularly to a flexible light rail which may be used for commercial, residential, and display lighting purposes.

2. Description of the Prior Art

Lighting fixtures are available in a tremendous variety of categories, including desk or table lamps, ceiling fixtures, fluorescent and neon tubing, and specialty lamps such as track lighting or spotlights. The present invention is directed to a lighting system which provides a continuous light strip of indefinite length.

Several prior art devices can provide successive lighting units which achieve the semblance of continuous lighting. An example of this is fluorescent tubing which may be laid end to end, with appropriate intervening sockets. One disadvantage to such a system, however, relates to the shadowy spots between successive tubes, which breaks up the continuous effect. A similar product which avoids these dark spots is neon (or other fluorescing gas) tubing which may be custom designed to any length and shape. Obviously, however, custom neon tubing can be prohibitively expensive. The color quality of fluorescent lamps is also inferior to incandescent or halogen type lamps.

Light rails have been devised which incorporate incandescent light bulbs. Two such light rails are depicted in U.S. Pat. Nos. 4,158,221 and 4,521,838, both issued to Y. Agabekov, on June 12, 1979, and June 4, 1985, respectively. Those devices essentially consist of a winged bar having two conductive strips, one on each wing of the rail. A series of tabs extend off the conducting strips, and are appropriately paired to receive tubular lamps. A similar rail is disclosed in U.S. Pat. No. 4,723,199 issued to Freed et al. (Mr. Freed being a co-inventor of the present invention) on Feb. 2, 1988.

One problem with each of these devices is that the conductive strips are exposed along their entire length, requiring extra material costs to conform to safety standards such as those promulgated by Underwriter's Laboratories. More importantly, however, each of the aforesaid devices is rigid in nature, making it difficult, if not impossible, to conform the light rail to an irregular surface. Several rail segments may be successively joined by flexible wire couplings to reach around corners or change the direction of the rail; however, this can result in the aforementioned shadowy spots at these couplings, and true curvature of the rail can never be achieved. It would, therefore, be desirable and advantageous to devise a light rail of indefinite length which would be flexible in nature, yet still provide essentially continuous lighting.

SUMMARY OF THE INVENTION

Accordingly, the primary object of the present invention is to provide a light rail of indefinite length, subject to acceptable amperage capacities.

Another object of the invention is to provide such a rail that is flexible so as to conform to irregular mounting surfaces.

Still another object of the invention is to provide a safer light rail whose conducting strips are enclosed in an insulative material.

Yet another object of the invention is to provide a flexible light rail system which may be assembled in segments without creating undesirable shadow areas.

A further object of the invention is to provide such a light rail which may be easily mounted to flat surfaces as well as in corners.

Another object of the invention is to provide a method of manufacturing such a light rail which is relatively inexpensive by conserving the amount of construction materials.

Another object of the invention is to provide a flexible light rail with all of the above set forth advantages as well as a curved reflective surface integral with the thermoplastic layers for improved reflection therefrom.

The foregoing objects are achieved in a flexible light rail system having two generally parallel conducting strips enclosed in by thermoplastic layers. The conducting strips are flat and lie in essentially the same plane, both strips being cut out from a single larger band of conducting material. Portions of the conducting strips form tabs which extend through slots in the upper thermoplastic layer. A special coupler allow successive rails to be joined with lamps installed at the joints.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

DESCRIPTION OF THE PREFERRED EMBODIMENTS

Figure 1:
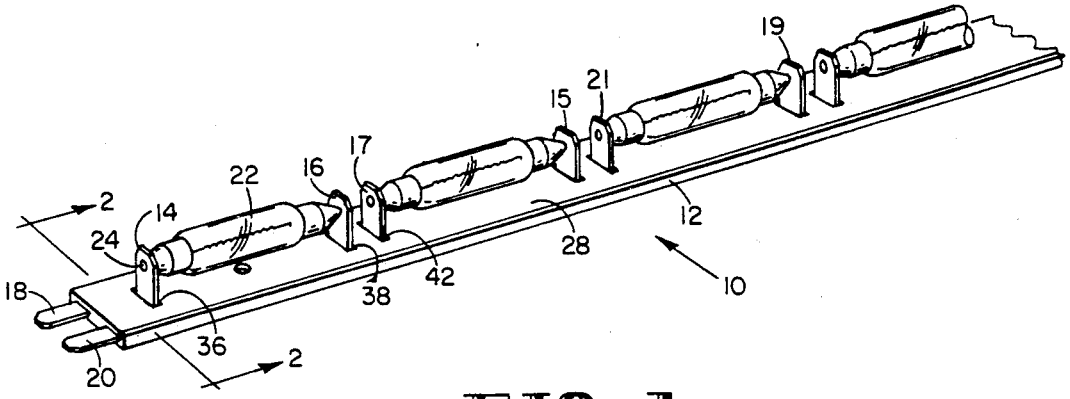
FIG. 1 is a perspective view showing the flexible light rail of the present invention with accessory lamps.

With reference now to the figures, and in particular with reference to FIG. 1, there is depicted the light rail 10 of the present invention. Light rail 10 is generally comprised of a track 12, successive pairs of contact tabs 14 and 16, and male plugs 18 and 20. Interposed between contact tabs 14 and 16 is a tube or festoon lamp 22. Light rail 10 is designed to be used with incandescent lamps, although the power supply and tabs could be modified for use with fluorescent mini-tube installation. Further, other lamp adapters, such as the halogen insert and rotatable lamp holder depicted in U.S. Pat. No. 4,569,568 (hereby incorporated by reference), may be used in conjunction with the present light rail 10.

Figure 2:
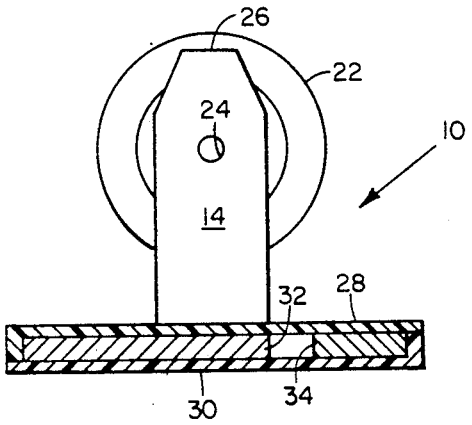
FIG. 2 is a cross-sectional view taken along lines 2—2 of FIG. 1.

As shown in FIG. 2, which is a cross-sectional view of light rail 10 taken along lines 2—2 of FIG. 1, contact tab 14 (as well as each of the other contact tabs), extends essentially perpendicular to the surface of track 12. The surface of contact tab 14 is also in a plane perpendicular to the longitudinal axis of light rail 10. A hole 24 is cut in tab 14 to receive one end of lamp 22. This secures lamp 22 in place, as well as providing an electrical contact, and should be located toward the upper end 26 of tab 14 in order to insure adequate clearance of lamp 22 above track 12. Alternatively, a small indentation or depression designed to accommodate the end of lamp 24 could be substituted for hole 24. Also, the upper end 26 of tab 14 is tapered somewhat to facilitate installation of the aforementioned adapters which have portions sliding over tab 14.

FIG. 2 also reveals that track 12 is actually comprised of an upper track 28 and a lower track 30. Upper track 28 and lower track 30 are essentially identical, except for the cutouts in upper track 28 (described below). In cross-section, both are an exaggerated L-shape. Since light rail 10 is to be flexible, upper and lower tracks 28 and 30 must be constructed of an appropriately pliant material. It should also be electrically insulative, and preferably able to withstand the high temperatures of adjacent incandescent lamp 22. Furthermore, in order to make the product in an inexpensive manner, it should be formed in an extrusion process. For these reasons, it is suggested that upper and lower tracks 28 and 30 be constructed of a plastic material, and the inventors have found that polyethersulphone is particularly suited for this application. Polyethersulphone (PES) is a high temperature thermoplastic, and can be obtained from Imperial Chemical Industries of Wilmington, Del., under the brand name VICTREX. PES may conveniently be sonic welded, and comes in a white color which is desirable for reflection properties. Upper track 28 may also be concave to further enhance reflective properties.

Figure 3:
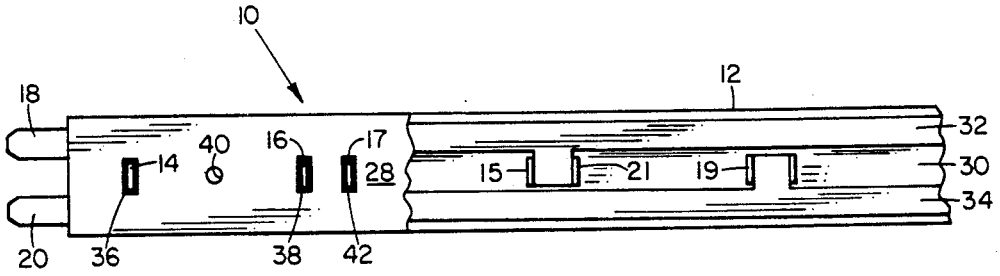
FIG. 3 is a top plan view of flexible light rail with the accessory bulbs removed, showing a partial cutout.
Figure 4:
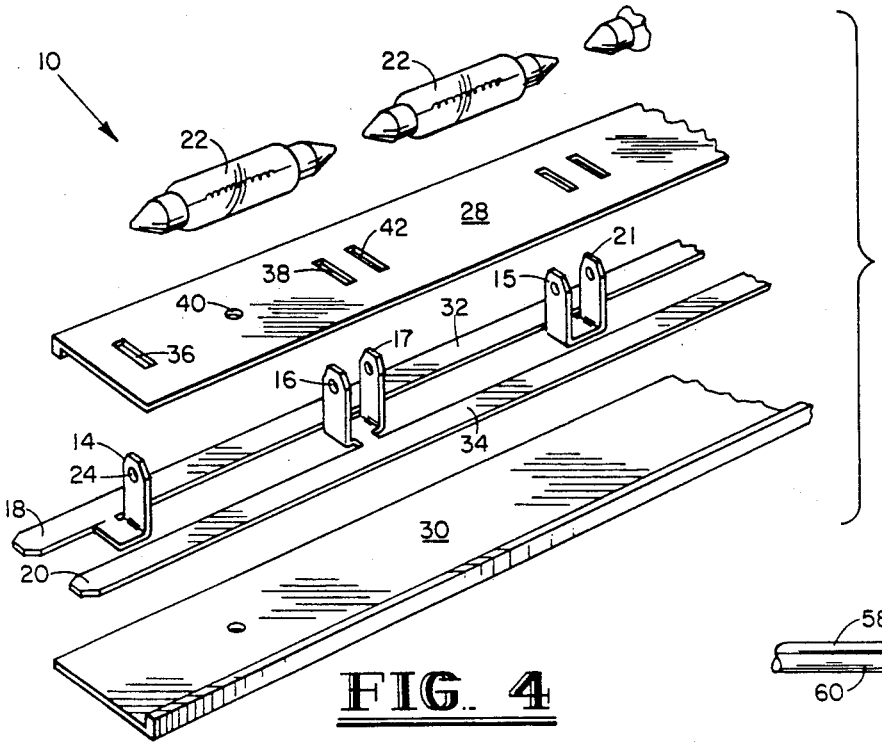
FIG. 4 is an exploded perspective view of the invention as shown in FIG. 1.

FIG. 2 additionally shows that upper and lower tracks 28 and 30 contain therebetween two conductive strips 32 and 34. This is shown more clearly in FIGS. 3 and 4, to which attention is now directed. FIG. 3 is a top plan view of FIG. 1, with the tube lamps removed, and further with a partial cutout showing conductive strips 32 and 34 lying below upper track 28. FIG. 4 is an exploded perspective view of FIG. 1. Tabs 14 and 16 extend upward from, and are integral with, conductive strips 32 and 34, respectively, in a manner to be discussed below in conjunction with FIG. 5.

As can be seen in FIG. 3, there are small slits 36 and 38 in upper track 28 through which tabs 14 and 16, respectively, protrude. A hole 40 may also be conveniently placed in upper track 28 for receiving a screw to secure rail 10 to the wall, ceiling, or other flat surface. Upper track 28 must be subjected to a cutting process in fabrication anyway, to create slits 36 and 38, so cutting hole 40 is easily accomplished in the same step. In the preferred embodiment, hole 40 is also made in lower track 30. For simplicity of manufacture, hole 40 may alternatively be made only in upper track 28, not lower track 30. Lower track 30 requires no slits since no tabs protrude therethrough and, since lower track 30 is relatively thin (as discussed below), a wood-type screw may easily be inserted through hole 40 in upper track 28, and then forced through lower track 30, before affixation to the supporting surface, such as a wall.

Figure 5:
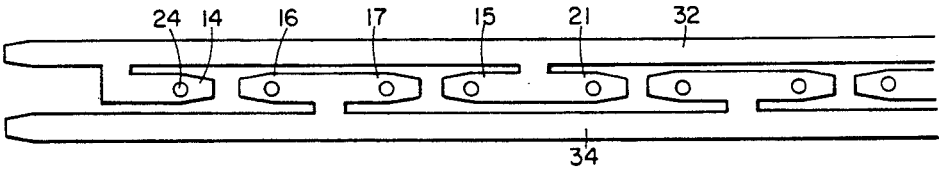
FIG. 5 is a top plan view showing the two inner conductive strips of the present invention before the contact tabs have been bent.

With reference now to FIG. 5, conductive strips 32 and 34 are further explained. Conductive strips 32 and 34 are constructed of an electrically conductive material, and the inventors have found that, for various reasons, a copper/brass alloy is preferable. Conductive strips 32 and 34 are both derived from a single piece of the material. Plugs 18 and 20 are preferably tapered to accommodate the feed plug discussed below in conjunction with FIGS. 6A and 6B.

As noted in U.S. Pat. No. 4,158,221, manufacture of the conductor strips has, in the past, been relatively complicated since several cutting templates were required, and cutting of the metal bars involved a substantial waste of material. Indeed, if conductive strips 32 and 34 were fabricated from two different metal bars, the material between successive tabs on a given strip would be totally lost. Here, however, the inventors have discovered economy of manufacture in constructing both conductive strips 32 and 34 from a single strip of the copper/brass alloy. FIG. 5 depicts strips 32 and 34 as they appear immediately after the cutting process. With prior art construction techniques, the material between successive tabs 14 and 15 on conductive strip 32 would have been wasted; however, the process contemplated by the inventors utilizes this material to form tabs 16 and 17. Similarly, the space between contact tabs 17 and 19 would be wasted, but it instead is used to form contact tabs 15 and 21. After cutting, tabs 14, 15, etc., are folded perpendicular to strips 32 and 34, preferably by automated means.

The cutting template that is used to form conductive strips 32 and 34 not only creates tabs 14, 15, etc., but also shapes plugs 18 and 20, and cuts out holes 24. Thus, the cutting process is but a single step. Conductive strips 32 and 34 are of indeterminate length, and a given strip may end with a single tab cutout, such as tab 14, or it may end with a double tab cutout, such as tabs 16 and 17, as discussed below in conjunction with FIG. 7. The location of slits 36 and 38 along upper track 28 mandates the spacing between conductive strips 32 and 34.

In order to be flexible enough to conform to irregular surfaces, rail 10, or more correctly, track 12, must be relatively thin. The inventors believe that the optimum total thickness of track 12, for most applications, is approximately two millimeters. Upper and lower tracks 28 and 30 are each approximately 0.5 millimeters thick, while conductive strips 32 and 34 are both approximately one millimeter thick. These measurements have been found to yield an appropriately flexible rail which can adapt to all but the most acute curves on a mounting surface.

In the preferred embodiment, where light rail 10 supports tube lamps approximately 40 millimeters long, the spacing between slits 36 and 38 (or tabs 14 and 16) is consequently approximately 40 millimeters, and the spacing between closely paired slits (i.e., tabs 16 and 17), is approximately 8 millimeters. Tabs 14, 15, etc., are approximately 12 millimeters high above their respective conductive strips, when folded. The width of rail 10 is not particularly critical. It must be wide enough to accommodate conductive strips of a manageable size, and still be narrow enough to remain unobtrusive. In the same embodiment referred to immediately above, conductive strips 32 and 34 are approximately 4 millimeters wide, and tabs 14 and 16 are approximately 5 millimeters wide. These widths, together with the 1.6 millimeter spacing previously referred to (on either side of a given tab), add the thickness of the edge portion of upper and lower tracks 28 and 30, yields an approximate total width for track 12 of 18 millimeters.

Those skilled in the art will appreciate, however, that these measurements are in no way absolute. An equivalent rail could be manufactured having a thicker track, and yet still remain flexible. Similarly, a wider track may be desirable in order to accommodate large tube lamps. These particular measurements merely embody the design anticipated to be optimum for most applications, e.g., room lighting.

Figure 6A:
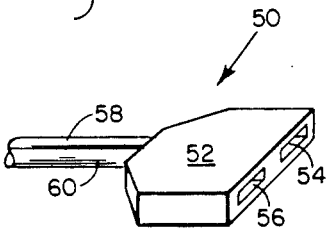
FIGS. 6A and 6B are a perspective view and top plan view, respectively, of the feed plug to be used with the flexible light rail.
Figure 6B:
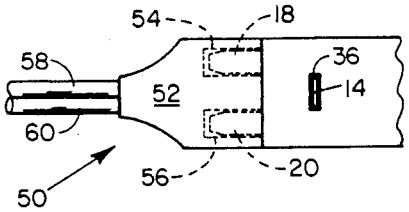

Referring now to FIGS. 6A and 6B, feed plug 50 is depicted. Feed plug 50 includes feed plug head 52, sockets 54 and 56 which mate with plugs 18 and 20, respectively, and lead wires 58 and 60. Lead wires 58 and 60 are electrically connected to sockets 54 and 56, respectively, within plug head 52. In the preferred embodiment, wires 58 and 60 are surrounded by a layer of plastic, and fixed to one another; appropriate lead wires are sold under the brand name ROMEX, or a similar UL-approved material. Lead wires 58 and 60 terminate at the secondary side of an appropriate power transformer (not shown) connected to main power lines, thus supplying rail 10 with electricity. Feed plug 50 may be fabricated from any insulative material, including polyethersulphone.

Figure 7:
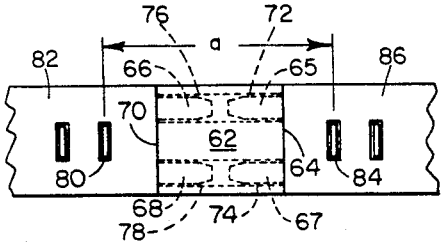
FIG. 7 is a top plan view of the electrical coupler used to attach successive light rails.

Another plug-type accessory used with light rail 10 is depicted in FIG. 7. As alluded to above, light rail 10 may be installed in segments, one segment being joined to another to form a continuous light rail of indeterminate length subject only to safety guidelines, such as the 1000-watt limit required by UL. In such a case, light rail 10 not only has source plugs 65 and 67 at its proximate end 64, but it additionally has terminal plugs 66 and 68 at its distal end 70. Electrical coupler 62 is used to join source plugs 65 and 67 of the next segment to terminal plugs 66 and 68, respectively Electrical coupler has four sockets 72, 74, 76, and 78 for receiving plugs 65, 67, 66, and 68, respectively. Socket 72 is electrically connected to socket 76 within coupler 62, and socket 74 is similarly connected to socket 78.

A key point of novelty with respect to the use of electrical coupler 62 is that it is designed such that a tube lamp 22 may be attached to rail 10 above coupler 62, to insure continuous lighting between successive rail segments, thereby avoiding undesirable dark spots. In this regard, two structural requirements must be noted. First of all, the terminal tab 80 on first rail segment 82 must be complementary with the initial tab 84 on second rail segment 86. In other words, if tab 84 is integral with the conductive strip corresponding to plug 65, then tab 80 should be integral with the conductive strip corresponding to plug 68. Otherwise, tabs 80 and 84 would lack polarity.

The second point with respect to electrical coupler 62 involves its length. If a tube lamp 22 or other light accessory is to fit between tabs 80 and 84, then the length of coupler 62 should be such that, when installed, the total length a between tabs 80 and 84 is equal to the length of the tube lamp. The length of coupler 62 is therefore dependent on the length of tube lamp 22, as well as the distance which rail segments 82 and 86 extend beyond tabs 80 and 84, respectively, toward coupler 62. In the preferred embodiment, distal end 70 of rail segment 82 extends approximately four millimeters past tab 80, and proximate end 64 of rail segment 86 extends approximately four millimeters past tab 84. Therefore, a coupler length of approximately 32 millimeters would yield a total length "a" of approximately 40 millimeters, the length of tube lamp 22. Of course, the length of coupler 62 will vary according to the size of the tube lamps used. Like feed plug 50, electrical coupler 62 can be fabricated from any suitable insulative material, including PES.

As an alternative to electrical coupler 62, the distal end 70 of rail segment 82 may end with female sockets which directly mate with source plugs 65 and 67. Distal end 70 would extend further past tab 80 than shown in FIG. 7, to maintain proper spacing for the lamp overlying the juncture.

Figure 8A:
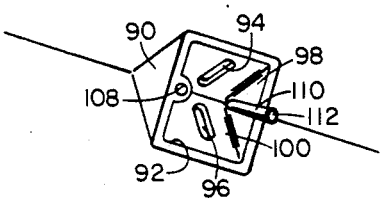
FIGS. 8A and 8B are perspective and elevational views, respectively, of the corner mount used to fix the light rail to a corner wall.
Figure 8B:
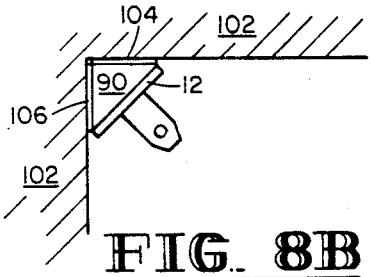

A final accessory for light rail 10 is shown in FIGS. 8A and 8B. Those figures depict corner mounting 90. As previously stated, light rail 10 may conveniently be attached to any relatively flat surface simply by inserting a screw through hole 40, lower track 30, and thence into the underlying surface. However, it is often desirable to place a light rail in a corner, for instance, between wall and ceiling (or two perpendicular walls). Corner mounting 90 is used to attach light rail 10 to such corners. Corner mounting 90 is essentially prism-shaped, i.e., it has a triangular cross-section, but appears rectangular when viewed from the top or bottom. It is somewhat hollowed out, forming a cavity 92. Two holes 94 and 96 are made in mounting surfaces 98 and 100, for receiving screws to secure corner mounting 90 to wall/ceiling 102. Alternatively, corner mounting 90 may be secured to wall/ceiling 102 by means of double-backed adhesive bands 104 and 106.

After placing one or more corner mountings 90 on wall/ceiling 102, light rail 10 may be secured thereto by any convenient means. For example, the previously mentioned screw which fits through hole 40 may be inserted into another hole 108 in corner mounting 90. Corner mounting 90 may optionally be fitted with a protuberance 110 having a hub 112 on the end thereof which snaps into a hole in track 12. A modified version of corner mounting 90 may be used to facilitate a 90° bend of rail 10 within a corner.

Figure 9A:
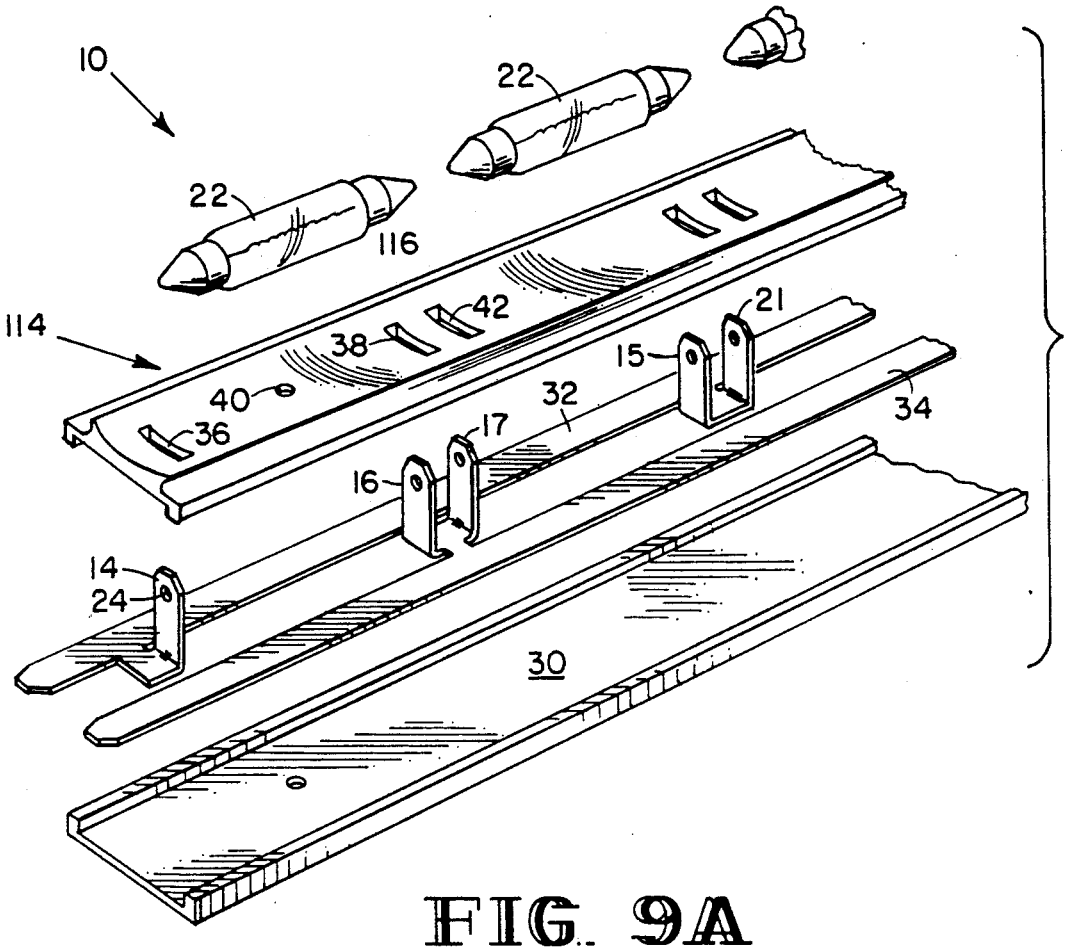
FIGS. 9A and 9B are cross-sectional and perspective views, respectively, of the light rail illustrating the integral curved reflecting surface.
Figure 9B:
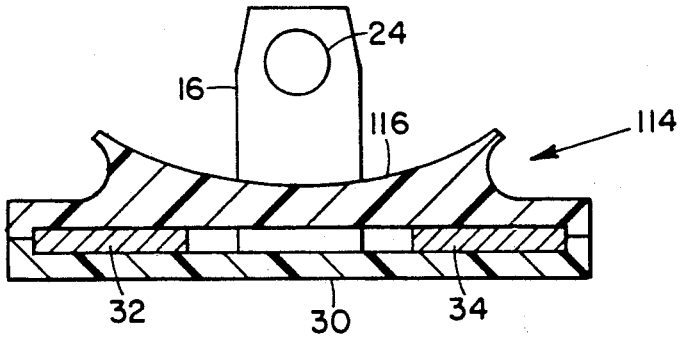

FIGS. 9A and 9B show an additional and novel embodiment of upper track 28. Outer surface 114 of upper track 28 is formed with a concave impression 116 thereupon. Slits 36 and 38 and hole 40 remain the same for the alternate embodiment as for the normal flat surfaced upper track 28.

Adding concave impression 116 creates a reflective surface that helps avoid the scalloping effect created when light, from lamp 22, incident upon a flat upper track 28, is reflected onto nearby surfaces. This scalloping effect appears as alternating light bands. The scalloping effect is reduced further when the distance between concave impression 116 and the filament of lamp 22 approximates the focal length of concave impression 116. In this configuration, light incident upon concave impression 116 is reflected generally parallel. The preferred radii of curvature of concave impression 116 is between 0.30 inches and 0.90 inches. The preferred focal length of concave impression between 116 is between 0.15 inches and 0.45 inches.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. It is therefore contemplated that the appended claims will cover such modifications that fall within the true scope of the invention.

I claim:

1. An apparatus for supporting a plurality of lighting fixtures comprising:

a first conductive strip having a first plurality of lateral extensions connected thereto, each of said first plurality of lateral extensions having attached thereto one or more first contact tabs, said first contact tabs being generally perpendicular to the surface of said first conductive strip;

a second conductive strip essentially parallel to said first conductive strip creating a space therebetween, said second conductive strip having a second plurality of lateral extensions connected thereto, each of said second plurality of lateral extensions having attached thereto one or more second contact tabs, said second contact tabs being generally perpendicular to the surface of said second conductive strip, said first and second contact tabs being located along said space between said first and second conductive strips; and means for electrically insulating said first and second conductive strips integral with means for reflecting light from said lighting fixtures said insulating means comprising an upper track with a concave reflective surface on the outside thereof and a lower track, said concave reflecting surface of said upper trace having a radius of curvature between 0.30 and 0.90 inch.

2. An apparatus for supporting a plurality of lighting fixtures comprising:

a first conductive strip having a first plurality of lateral extensions connected thereto, each of said first plurality of lateral extensions having attached thereto one or more first contact tabs, said first contact tabs being generally perpendicular to the surface of said first conductive strip;

a second conductive strip essentially parallel to said first conductive strip creating a space therebetween, said second conductive strip having a second plurality of lateral extensions connected thereto, each of said second plurality of lateral extensions having attached thereto one or more second contact tabs, said second contact tabs being generally perpendicular to the surface of said second conductive strip, said first and second contact tabs being located along said space between said first and second conductive strips; and means for electrically insulating said first and second conductive strips integral with means for reflecting light from said lighting fixtures said insulating means comprises an upper track with a concave reflective surface on the outside thereof and a lower track, said concave reflecting surface having a radius of curvature equal to substantially twice the distance between a filament of said lighting fixture and said concave reflecting surface.

3. A rail for supporting a plurality of lighting fixtures comprising:

a first flexible conductive strip having a first plurality of lateral extensions integral therewith, each of said first plurality of lateral extensions forming one or more first contact tabs, said first contact tabs being generally perpendicular to the surface of said first conductive strip;

a second flexible conductive strip essentially parallel to said first conductive strip creating a space therebetween, said second conductive strip having a second plurality of lateral extensions integral therewith, each of said second plurality of lateral extensions forming one or more second contact tabs, said second contact tabs being generally perpendicular to the surface of said second conductive strip and essentially parallel to said first contact tabs, said first and second contact tabs being located along said space between said first and second conductive strips, said first and second contact tabs forming successive contact pairs consisting of one of said first contact tabs and one of said second contact tabs;

an upper flexible track with a concave reflecting surface integral therewith, said upper flexible track having a plurality of slits therein, said first and second contact tabs passing through said slits, said upper track being adjacent to an upper surface of said first and second conductive strips; and a lower flexible track adjacent to a lower surface of said first and second conductive strips, said upper and lower tracks being attached to one another along their peripheries;

said concave reflective surface having a radius of curvature between 0.30 and 0.90 inch.

4. A rail for supporting a plurality of lighting fixtures comprising:

a first flexible conductive strip having a first plurality of lateral extensions integral therewith, each of said first plurality of lateral extensions forming one or more first contact tabs, said first contact tabs being generally perpendicular to the surface of said first conductive strip;

a second flexible conductive strip essentially parallel to said first conductive strip creating a space therebetween, said second conductive strip having a second plurality of lateral extensions integral therewith, each of said second plurality of lateral extensions forming one or more second contact tabs, said second contact tabs being generally perpendicular to the surface of said second conductive strip and essentially parallel to said first contact tabs, said first and second contact tabs being located along said space between said first and second conductive strips, said first and second contact tabs forming successive contact pairs consisting of one of said first contact tabs and one of said second contact tabs;

an upper flexible track with a concave reflecting surface integral therewith, said upper flexible track having a plurality of slits therein, said first and second contact tabs passing through said slits, said upper track being adjacent to an upper surface of said first and second conductive strips; and a lower flexible track adjacent to a lower surface of said first and second conductive strips, said upper and lower tracks being attached to one another along their peripheries;

said concave reflective surface having a radius of curvature equal to substantially twice the distance between a filament of said lighting fixture and said concave reflecting surface.

* * * * *